US009543097B2

(12) United States Patent
Suzuki et al.

(10) Patent No.: US 9,543,097 B2
(45) Date of Patent: Jan. 10, 2017

(54) CURRENT CONTROL DEVICE FOR SOLENOID, STORAGE MEDIUM STORING PROGRAM FOR CONTROLLING CURRENT OF SOLENOID, AND METHOD FOR CONTROLLING CURRENT OF SOLENOID

(71) Applicant: DENSO CORPORATION, Kariya, Aichi-pref. (JP)

(72) Inventors: Fuminori Suzuki, Okazaki (JP); Yuuta Mizuno, Anjo (JP)

(73) Assignee: DENSO CORPORATION, Kariya (JP)

( * ) Notice: Subject to any disclaimer, the term of this patent is extended or adjusted under 35 U.S.C. 154(b) by 229 days.

(21) Appl. No.: 14/199,062

(22) Filed: Mar. 6, 2014

(65) Prior Publication Data

US 2014/0254058 A1 Sep. 11, 2014

(30) Foreign Application Priority Data

Mar. 6, 2013 (JP) ..... 2013-044352
May 28, 2013 (JP) ..... 2013-111644

(51) Int. Cl.
*H01H 47/32* (2006.01)

(52) U.S. Cl.
CPC ..... *H01H 47/325* (2013.01)

(58) Field of Classification Search
CPC ..... H01H 47/325
USPC ..... 361/153
See application file for complete search history.

(56) References Cited

U.S. PATENT DOCUMENTS 5,762,581 A 6/1998 Kozaki et al.
2009/0015979 A1* 1/2009 Fukano ..... H01F 7/1844 361/152
2010/0108030 A1* 5/2010 Kusaka ..... F02D 31/007 123/357
2013/0270471 A1 10/2013 Kamio

FOREIGN PATENT DOCUMENTS

JP 10-019156 1/1998

* cited by examiner

*Primary Examiner* — Dharti Patel
(74) *Attorney, Agent, or Firm* — Nixon & Vanderhye P.C.

(57) ABSTRACT

A current control device sets a target current value of a solenoid, and sets a duty ratio of a PWM signal outputted to a drive circuit of a solenoid based on the target current value. The target current value is a value that periodically varies in a dither period longer than a PWM period of the PWM signal. A setting period of the target current value and a setting period of the duty ratio are shorter than the dither period. As compared with a configuration where the duty ratio is set in the dither period, a time period from a time a basic current value is changed to a time the duty ratio is renewed is shortened. A operation responsiveness of a movable core of the solenoid improves.

21 Claims, 13 Drawing Sheets

CURRENT CONTROL DEVICE FOR SOLENOID, STORAGE MEDIUM STORING PROGRAM FOR CONTROLLING CURRENT OF SOLENOID, AND METHOD FOR CONTROLLING CURRENT OF SOLENOID

CROSS REFERENCE TO RELATED APPLICATION

This application is based on Japanese Patent Applications No. 2013-44352 filed on Mar. 6, 2013 and No. 2013-111644 filed on May 28, 2013, the disclosures of which are incorporated herein by reference.

TECHNICAL FIELD

The present disclosure relates to a current control device for controlling a current of a solenoid, a storage medium storing a program for controlling a current of a solenoid, and a method for controlling a current of a solenoid.

BACKGROUND

For example, a solenoid is generally used for an actuator of a cylinder, an electromagnetic valve and the like. For example, JP10-19156A discloses a current control device that controls an exciting current of a solenoid of an electromagnetic valve by a pulse width modulation (PWM) signal.

In JP10-19156A, the exciting current is periodically varied in a dither period having a length of several times a pulse period of the PWM signal so as to create small oscillation of a spool of the electromagnetic valve, thereby to reduce an appearance of hysteresis characteristics caused by the static friction of the spool.

In JP10-19156A, a duty ratio of the PWM signal for generating the exciting current as a target is set according to each dither period. Therefore, if the target is changed during the dither period, this change is reflected on the duty ratio of the PWM signal when the next dither period elapses. Namely, the renewing of the duty ratio of the PWM signal delays from the timing where the target is changed. Therefore, an operation responsiveness of a movable core driven by the solenoid is low.

SUMMARY

It is an object of the present disclosure to provide a current control device which is capable of improving an operation responsiveness of a movable core driven by a solenoid. It is another object of the present disclosure to provide a program storage medium and a method for controlling a current of a solenoid for improving an operation responsiveness of the movable core driven by the solenoid.

According to an aspect of the present disclosure, a current control device relates to a device to control an exciting current of a solenoid. The current control device includes a target setting section, a duty ratio setting section and a signal generating section. The target setting section sets a target current value of the exciting current. The duty ratio setting section sets a duty ratio of a pulse width modulation signal to be provided to a drive circuit of the solenoid based on the target current value. The signal generating section generates the PWM signal. The target current value is a value that periodically varies in a dither period longer than a pulse period of the PWM signal. A period that the target setting section sets the target current value is referred to as a first setting period, and a period that the duty ratio setting section sets the duty ratio is referred to as a second setting period. The first setting period and the second setting period are shorter than the dither period.

In the current control device, a period of time from a time the target current value is changed to a time the duty ratio of the PWM signal is renewed is shortened, as compared with a configuration in which the duty ratio is set in each dither period. Therefore, an operation responsiveness of a movable core of the solenoid improves.

For example, the first setting period and the second setting period may be equal to or shorter than the PWM period. In such a case, the operation responsiveness of the movable core of the solenoid further improves.

According to an aspect of the present disclosure, a non-transitory computer readable storage medium includes instructions to be executed by a computer for controlling an exciting current of a solenoid, the instructions for implementing setting a target current value of the exciting current in a first setting period, setting a duty ratio of a pulse width modulation (PWM) signal provided to a drive circuit of the solenoid based on the target current value in a second setting period, and generating the PWM signal. The target current value is a value that periodically varies in a dither period longer than a PWM period, which is a pulse period of the PWM signal. The first setting period and the second setting period are shorter than the dither period.

According to an aspect of the present disclosure, a method for controlling an exciting current of a solenoid includes setting a target current value of the exciting current in a first setting period, setting a duty ratio of a pulse width modulation (PWM) signal provided to a drive circuit of the solenoid based on the target current value in a second setting period, and generating the PWM signal. The target current value is a value that periodically varies in a dither period longer than a PWM period, which is a pulse period of the PWM signal. The first setting period and the second setting period are shorter than the dither period.

BRIEF DESCRIPTION OF THE DRAWINGS

The above and other objects, features and advantages of the present disclosure will become more apparent from the following detailed description made with reference to the accompanying drawings, in which like parts are designated by like reference numbers and in which.

DETAILED DESCRIPTION

Embodiments of the present disclosure will be hereinafter described with reference to the drawings. Throughout the embodiments, like parts will be designated with like reference numbers, and descriptions thereof will not be repeated.

First Embodiment

Figure 1:
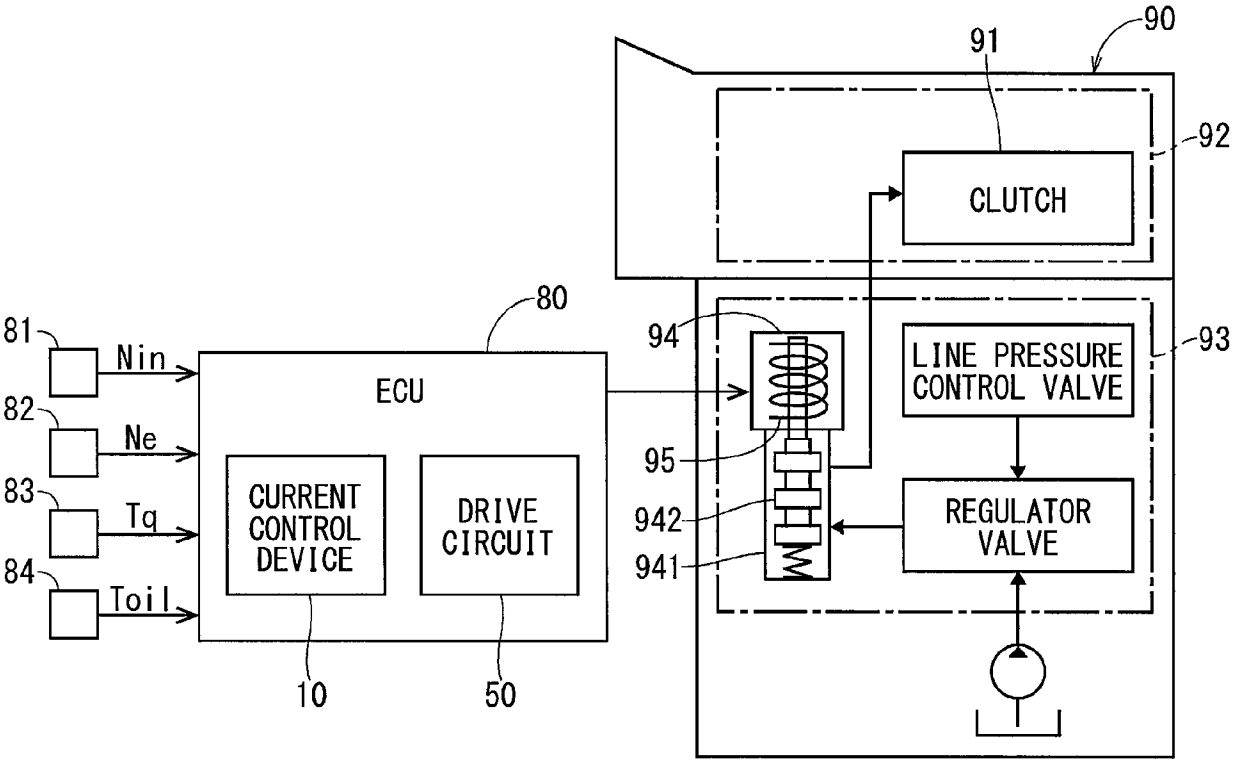
FIG. 1 is a block diagram illustrating an automatic transmission and an electronic control unit to which a current control device according to a first embodiment of the present disclosure is employed.

An electronic control unit to which a current control device according to a first embodiment of the present disclosure is employed is shown in FIG. 1. For example, an electronic control unit 80 is adapted to control a gear ratio of an automatic transmission 90 of a vehicle. The automatic transmission 90 includes a transmission device 92 and a hydraulic circuit 93. The transmission device 92 includes a plurality of hydraulic actuators including a clutch 91. The hydraulic circuit 93 regulates a pressure of hydraulic oil supplied to each of the hydraulic actuators.

The current control device 10 controls an exciting current of a solenoid 95 of a linear solenoid valve 94, thereby to control the pressure of the hydraulic oil supplied to the clutch 91. The linear solenoid valve 94 is a spool-type solenoid valve including a sleeve 941 and a spool 942. The sleeve 941 has a plurality of ports. The spool 942 has a shaft shape with steps for switching on and off of communication of each port within the sleeve 941. The spool 942 is movable in an axial direction with a movable core disposed inside of the solenoid 95.

Figure 2:
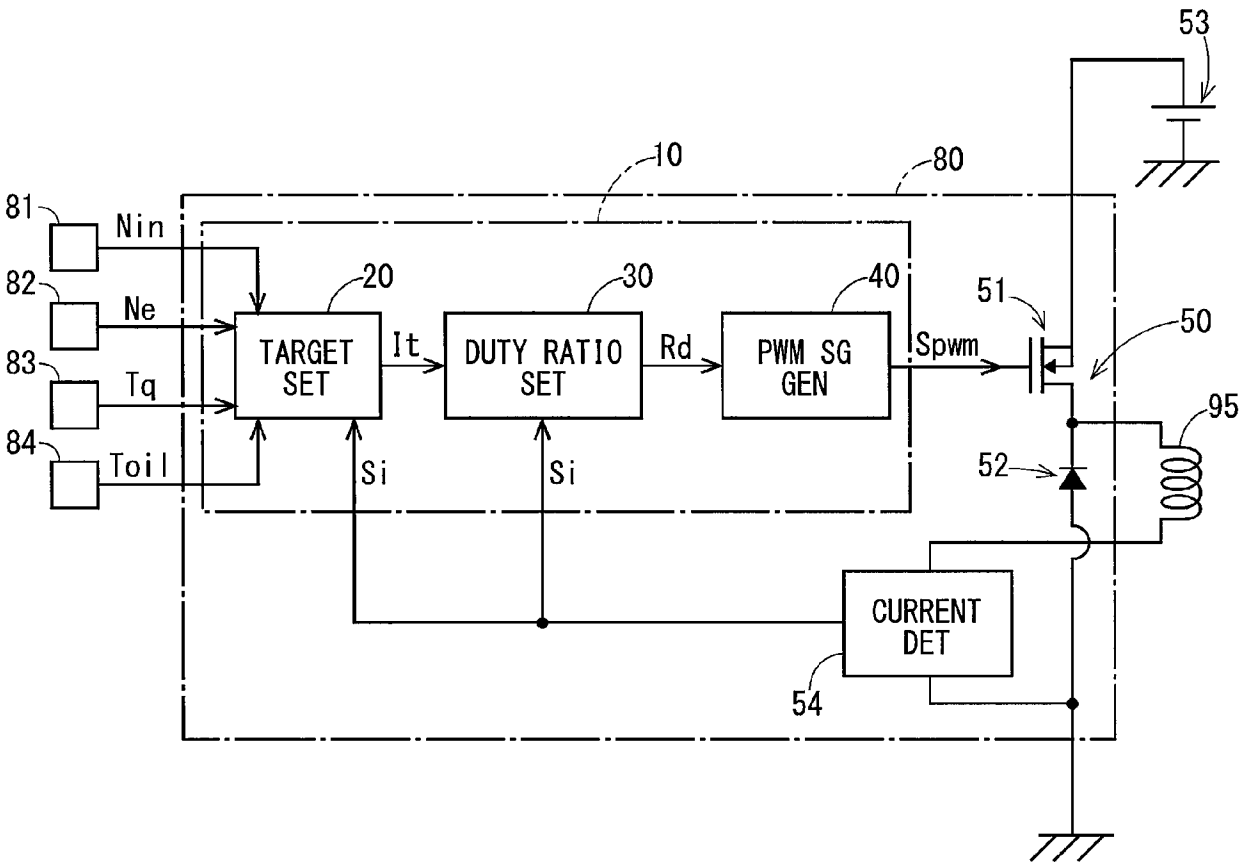
FIG. 2 is a block diagram illustrating the electronic control unit shown in FIG. 1.

A structure of the electronic control unit 80 will be hereinafter described with reference to FIG. 2. The electronic control unit 80 includes the current control device 10 and a drive circuit 50.

The current control device 10 is provided by a microcomputer including a CPU, a RAM, a ROM and the like. The current control device 10 operates the drive circuit 50 by performing processing in accordance with a program based on detection signals from various sensors, such as an input rotation speed sensor 81, an engine speed sensor 82, an engine torque sensor 83, and an oil temperature sensor 84. The current control device 10 receives the detection signals from the sensors through an input circuit (not shown).

The current control device 10 includes a target setting section 20, a duty ratio setting section 30 and a PWM signal generating section 40. The target setting section 20 sets a target current value It, which is a target value of the exciting current of the solenoid 95. The duty ratio setting section 30 sets a duty ratio Rd of the PWM signal Spwm outputted to the drive circuit 50 based on the target current value It. The PWM signal generating section 40 generates the PWM signal Spwm, and outputs the PWM signal Spwm to the drive circuit 50. The target current value It is a value periodically varying in a dither period Td that is longer than a PWM period Tpwm. The PWM period Tpwm is a pulse period of the PWM signal Spwm. In the present embodiment, the length of the dither period Td is ten times the length of the PWM period Tpwm.

The drive circuit 50 includes a transistor 51, a diode 52 and a current detecting section 54. The transistor 51 is connected in series to the solenoid 95. The transistor 51 serves as a switching element. The diode 52 is connected in series to the transistor 51, and in parallel to the solenoid 95. The diode 52 serves as a freewheel element. The current detecting section 54 is connected in series to the solenoid 95. The transistor 51 repeats its on and off operations in accordance with the PWM signal Spwm outputted from the current control device 10 to connect or disconnect between the solenoid 95 and a power source 53. In this case, the exciting current flowing in the solenoid 95 periodically varies in the dither period Td. Thus, the spool 942, which is integral with the movable core disposed inside of the solenoid 95, creates small oscillations according to the periodic change of the exciting current. When the transistor 51 is off, a flywheel current of the solenoid 95 flows in a ground GND through the diode 52.

The current detecting section 54 detects an actual exciting current of the solenoid 95. The current detecting section 54 generates and provides an exciting current signal Si corresponding to the detected exciting current to the current control device 10. In the present embodiment, for example, the current detecting section 54 includes a resistor, an amplifier, a filter, and a converter. The resistor is connected in series to the solenoid 95. The amplifier amplifies a voltage that is generated at the opposite ends of the resistor and is proportional to the exciting current. The filter removes noise from the amplified voltage. The converter converts the output of the filter into a digital value. The exciting current signal Si is used for a feedback control, which will be described later.

Figure 3:
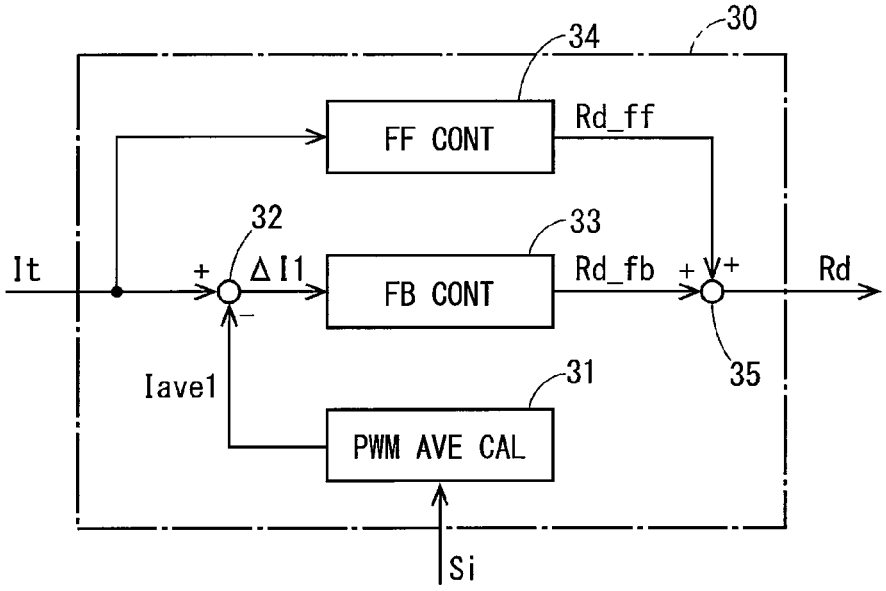
FIG. 3 is a block diagram illustrating a duty ratio setting section of the electronic control unit shown in FIG. 2.

Next, a structure of the duty ratio setting section 30 will be described in detail with reference to FIG. 3. The duty ratio setting section 30 includes a PWM average calculating portion 31, a subtracting portion 32, a feedback control portion 33, a feed-forward control portion 34 and an adding portion 35.

The PWM average calculating portion 31 calculates a PWM average current value Iave1, which is an average value of the exciting current of the solenoid 95 in one PWM period. The subtracting portion 32 calculates a deviation ΔI1 between the target current value It and the PWM average current value Iave1. The feedback control portion 33 calculates a feedback term Rd_fb based on the deviation ΔI1. The feed-forward control portion 34 calculates a feed-forward term Rd_ff based on the target current value It. The adding portion 35 adds the feed-forward term Rd_ff and the feedback term Rd_fb to obtain the duty ratio Rd. The duty ratio setting section 30 is a regulating portion of a control system for regulating the duty ratio Rd so that the target current value It coincides with the PWM average current value Iave1.

Figure 4:
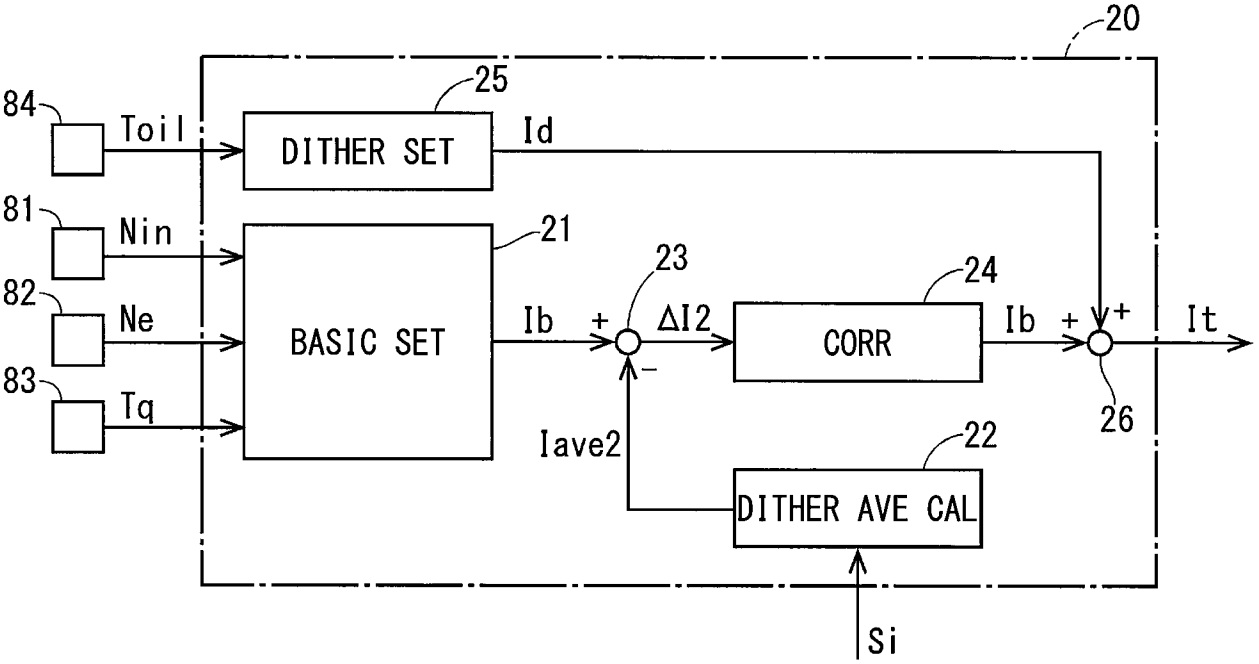
FIG. 4 is a block diagram illustrating a target setting section of the electronic control unit shown in FIG. 2.

Next, a structure of the target setting section 20 will be described in detail with reference to FIG. 4. The target setting section 20 includes a basic setting portion 21, a dither average calculating portion 22, a subtracting portion 23, a correcting portion 24, a dither setting portion 25 and an adding portion 26.

The basic setting portion 21 calculates a required oil pressure value based on an operation state of the vehicle detected by various sensors, and sets a basic current value Ib corresponding to the required oil pressure value. The required oil pressure value is a required value of an output oil pressure of the linear solenoid valve 94. A state where the output oil pressure of the linear solenoid valve 94 has the required oil value corresponds to a desired operation state of the solenoid.

The dither average calculating portion 22 calculates a dither average current value Iave2, which is an average value of the exciting current of the solenoid 95 in one dither period Td. The subtracting portion 23 calculates a deviation ΔI2 between the basic current value Ib and the dither average current value Iave2. The correcting portion 24 corrects the basic current value Ib based on the deviation ΔI2. In the present embodiment, correction by a PI control is performed.

The dither setting portion 25 sets a dither current value Id that periodically varies in the dither period Td. The dither current value Id is an oscillating component of the target current value It to create small oscillation of the spool of the linear solenoid valve 94. In the present embodiment, a dither amplitude Ad, which is an amplitude of the dither current value Id, is set in accordance with an oil temperature Toil of the hydraulic circuit 93. The oil temperature Toil corresponds to a correlation value of an ambient temperature of the solenoid. The adding portion 26 corresponds to a target calculating portion. The adding portion 26 calculates the target current value It by adding the basic current value Ib and the dither current value Id.

In the present embodiment, a period that the target setting section 20 sets the target current value It is referred to as a first setting period T1. A period that the duty ratio setting section 30 sets the duty ratio Rd is referred to as a second setting period T2. The length of the first setting period T1 and the length of the second setting period T2 are equal to the length of the PWM period Tpwm. That is, the target current value It and the duty ratio Rd are set each time the PWM period Tpwm elapses, that is, in each PWM period Tpwm. For example, the target current value It and the duty ratio Rd are renewed ten times while one dither period Td elapses.

Figure 5:
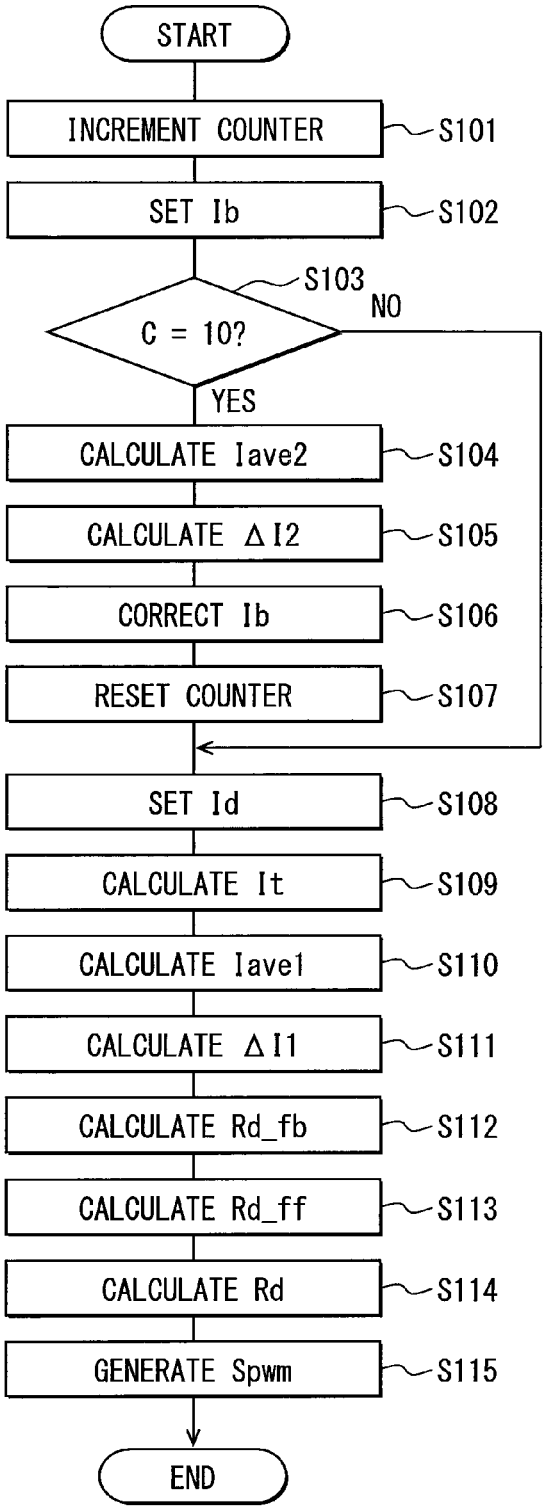
FIG. 5 is a flowchart illustrating a control operation of the current control device shown in FIG. 2.

Next, a control process of the current control device 10 will be described with reference to FIG. 5. A series routine illustrated in FIG. 5 is repeatedly performed at a predetermined time interval, after a main switch of the vehicle is turned on and until the main switch of the vehicle is turned off. In the present embodiment, the predetermined time interval coincides with the PWM period Tpwm. When this routine is performed first time, a counter is reset. Various parameters used in the processing described hereinafter are stored in a storage, such as a RAM, as needed, and are renewed as needed.

When the routine of FIG. 5 begins, the counter is incremented at S101. That is, a count value C increments by 1.

Next, at S102, the required oil pressure of the linear solenoid valve 94 is calculated based on the operation state of the vehicle detected by various sensors, and the basic current value Ib corresponding to this required oil pressure value is set.

At S103, it is determined whether the count value C is 10 or not. When it is determined that the count value C is 10 (S103: YES), the process proceeds to S104. When it is determined that the count value C is not 10 (S103: NO), the process proceeds to S108.

At S104, the dither average current value Iave2, which is the average value of the exciting current of the solenoid 95 in one dither period Td, is calculated.

At S105, the deviation ΔI2 between the basic current value Ib and the dither average current value Iave2 is calculated.

At S106, the basic current value Ib is corrected based on the deviation ΔI2 by the PI control.

At S107, the counter is reset. That is, the count value C is set to 0. After S107, the process proceeds to S108.

At S108, the dither current value Id, which periodically varies in the dither period Td, is set. The dither amplitude Ad is set in accordance with the oil temperature Toil of the hydraulic circuit 93.

At S109, the target current value It is calculated by adding the basic current value Ib and the dither current value Id.

At S110, the PWM average current value Lave1, which is the average value of the exciting current of the solenoid 95 in one PWM period Tpwm, is calculated.

At S111, the deviation ΔI1 between the target current value It and the PWM average current value Iave1 is calculated.

At S112, the feedback term Rd_fb is calculated based on the deviation ΔI1.

At S113, the feed-forward term Rd_ff is calculated based on the target current value It.

At S114, the duty ratio Rd is calculated by adding the feed-forward term Rd_ff and the feedback term Rd_fb.

At S115, the PWM signal Spwm corresponding to the duty ratio Rd is generated, and outputted to the drive circuit 50. After S115, the process ends the routine shown in FIG. 5.

Figure 6:
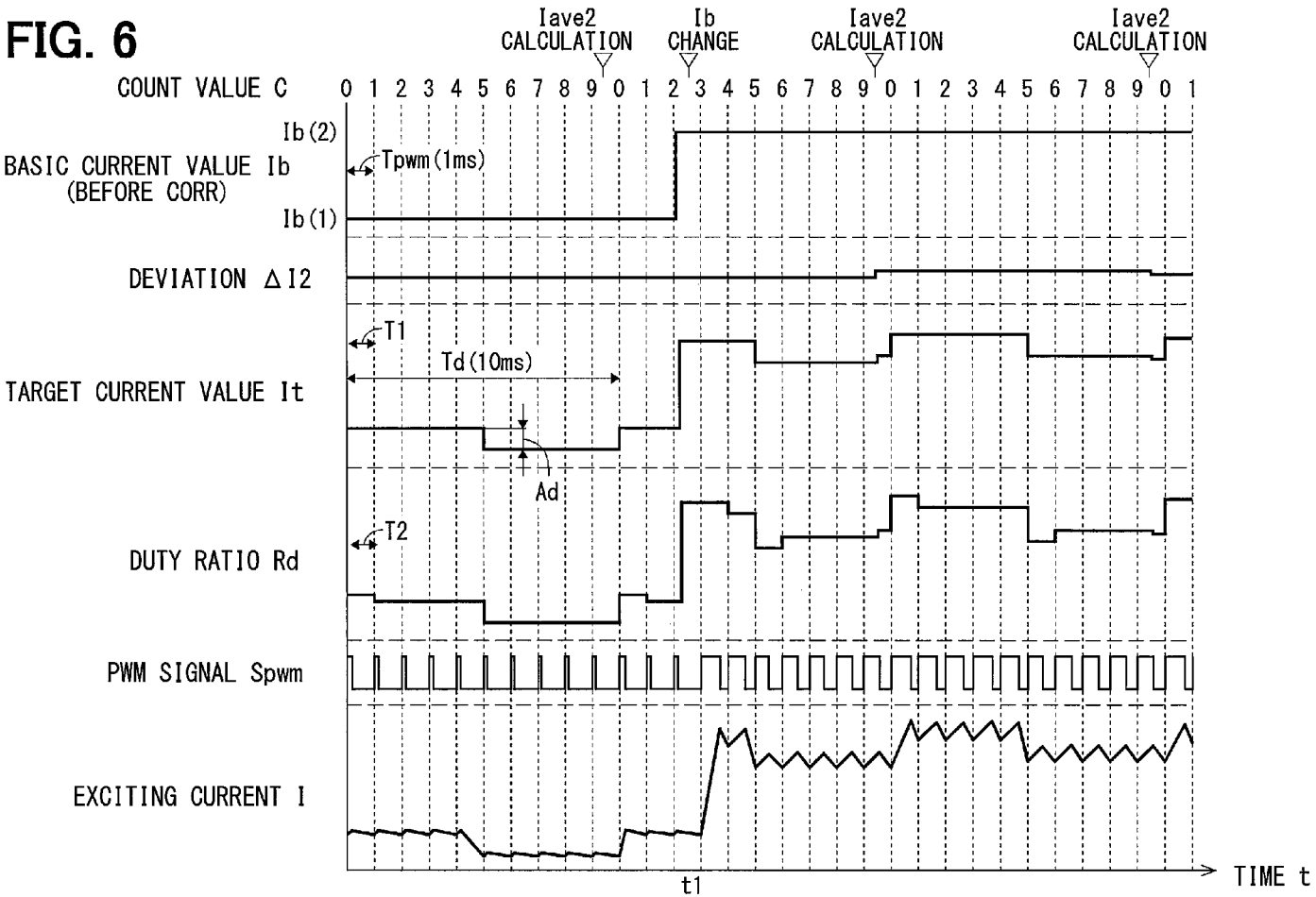
FIG. 6 is a time chart illustrating an example of a change of an exciting current of a linear solenoid valve shown in FIG. 1.

FIG. 6 illustrates a change of the exciting current I with time when the basic current value Ib is changed from a first predetermined current value Ib(1) to a second predetermined current value Ib(2). When the basic current value Ib is the first predetermined current value Ib(1), which is relatively small, the fluctuation of the exciting current I within the PWM period Tpwm is very small, and does not contribute to the small oscillation of the spool of the linear solenoid valve 94.

The fluctuation of the exciting current I within the dither period Td causes the small oscillation of the spool of the linear solenoid valve 94 and reduces an appearance of the hysteresis characteristics resulting from the static friction of the spool. In the present embodiment, the dither current value Id is varied in such a manner that the dither current value Id repeats a small value and a large value in a period of half the dither period Td.

The length of the first setting period T1 and the length of the second setting period T2 are equal to the length of the PWM period Tpwm. That is, the target current value It and the duty ratio Rd are set each time one PWM period Tpwm elapses. Therefore, when the basic current value Ib is changed from the first predetermined current value Ib(1) to the second predetermined current value Ib(2) at a time t1, the target current value It and the duty radio Rd are renewed within the PWM period Tpwm, and thus the exciting current I promptly changes.

Similar to the case where the basic current Ib is at the first predetermined current value Ib(1), when the basic current value Ib is at the second predetermined current value Ib(2), the fluctuation of the exciting current I within the dither period Td creates the small oscillation of the spool of the linear solenoid valve 94, and reduces the appearance of the hysteresis characteristic caused by the static friction of the spool.

Figure 7:
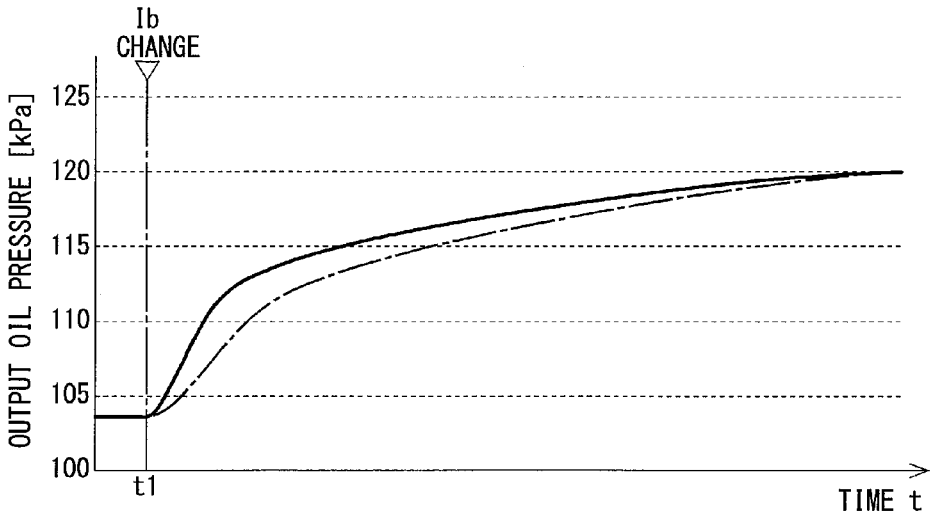
FIG. 7 is a time chart illustrating an example of a change of an output oil pressure of the linear solenoid valve shown in FIG. 1.

FIG. 7 illustrates a change of the output oil pressure of the linear solenoid valve 94 with time, when the output oil pressure of the linear solenoid valve 94 changes from 103 [kPa] to 120 [kPa] in a certain operation state. In FIG. 7, a solid line represents a change of the output oil pressure of the present embodiment. In FIG. 7, a single dashed-chain line represents a change of the output oil pressure of a comparative example in which the exciting current is not periodically changed in the dither period Td.

As shown in FIG. 7, in the present embodiment, a waste time is shortened by 32.3 [ms], as compared with the comparative example. Also, a response time is shortened by 420 [ms] at 63.2%.

Figure 8:
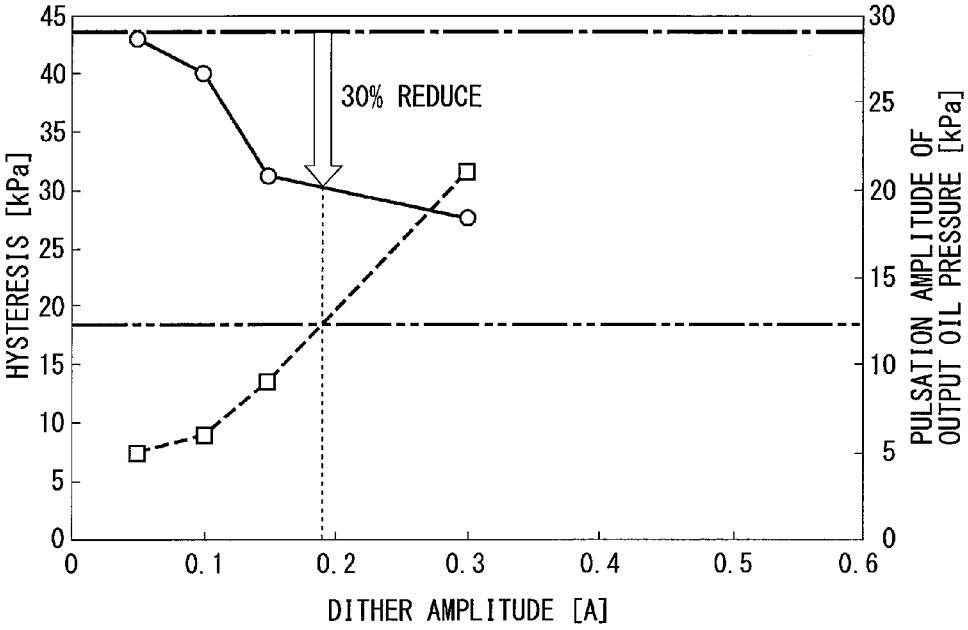
FIG. 8 is a graph illustrating a relationship between a dither amplitude and a hysteresis and a relationship between the dither amplitude and a pulsation amplitude of the output oil pressure according to the first embodiment and a comparative example to the first embodiment.

FIG. 8 is a graph illustrating a hysteresis [kPa] and an amplitude [kPa] of pulsation of the output oil pressure of the linear solenoid valve 94 of the present embodiment and the comparative example. In FIG. 8, a solid line represents a relationship between the dither amplitude and the hysteresis of the present embodiment, and a dashed line represents a relationship between the dither amplitude and the pulsation amplitude of the present embodiment. Further, a single dashed-chain line represents the hysteresis of the comparative example, and a double dashed-chain line represents the pulsation amplitude of the comparative example.

In the present embodiment, the hysteresis reduces by 30% from that of the comparative example, under a condition of the same pulsation amplitude.

In the current control device 10 according to the first embodiment, as described above, the target current value It and the duty ratio Rd are set in each PWM period Tpwm. Therefore, the time period (renewing time period) from the time the basic current value Ib is changed to the time the duty ratio Rd of the PWM signal Spwm is renewed is shortened, as compared with a conventional device in which the duty ratio is set in each dither period.

In the case where the PWM period is 1 [ms] and the dither period is 10 [ms], the renewing time period is shortened by 9 [ms] at most. Therefore, the operation responsiveness of the movable core of the solenoid 95, that is, the responsiveness of the output oil pressure of the linear solenoid valve 94 improves.

In the first embodiment, the dither setting portion 25 of the target setting section 20 sets the dither amplitude Ad in accordance with the oil temperature Toil of the oil pressure circuit 93. Therefore, the dither amplitude Ad can be suitably set in accordance with the oil temperature Toil.

Second Embodiment

A current control device according to a second embodiment of the present disclosure will be described with reference to FIGS. 9 to 15.

In a system where the output oil pressure of the linear solenoid valve 94 connected to the clutch 91 of the automatic transmission 90 is regulated by controlling the exciting current of the solenoid 95, there is a fear that the output oil pressure of the linear solenoid valve 94 pulsate depending on an operation state such as the oil temperature Toil of the hydraulic circuit 93 and the rotation speed of the automatic transmission 90. In a conventional system, therefore, a damper is used between the linear solenoid valve 94 and the clutch 91 so as to reduce the pulsation of the output oil pressure of the linear solenoid valve 94. In such a structure, however, the size of the automatic transmission increases, and the costs increases.

Figure 9:
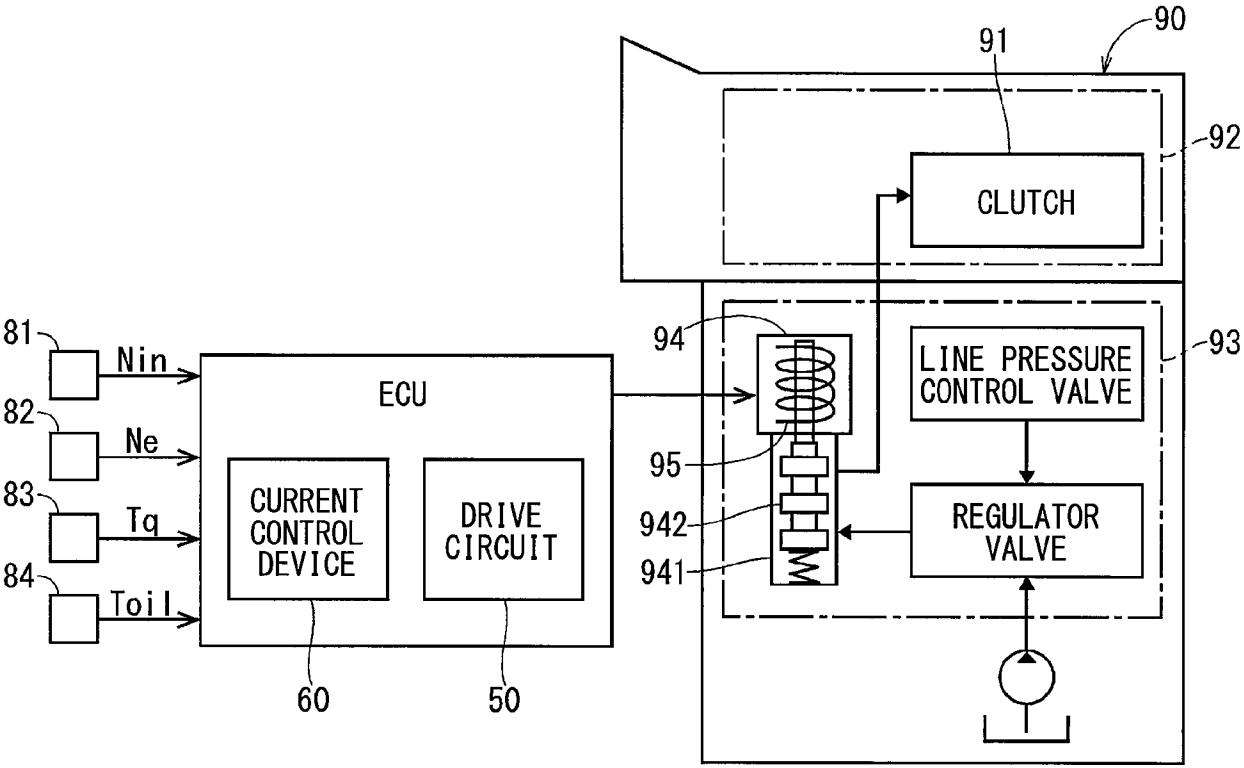
FIG. 9 is a block diagram illustrating an automatic transmission and an electronic control unit to which a current control device according to a second embodiment of the present disclosure is employed.

In the second embodiment, a current control device 60 shown in FIG. 9 has a function of reducing the pulsation of the output oil pressure of the linear solenoid valve 94.

Figure 10:
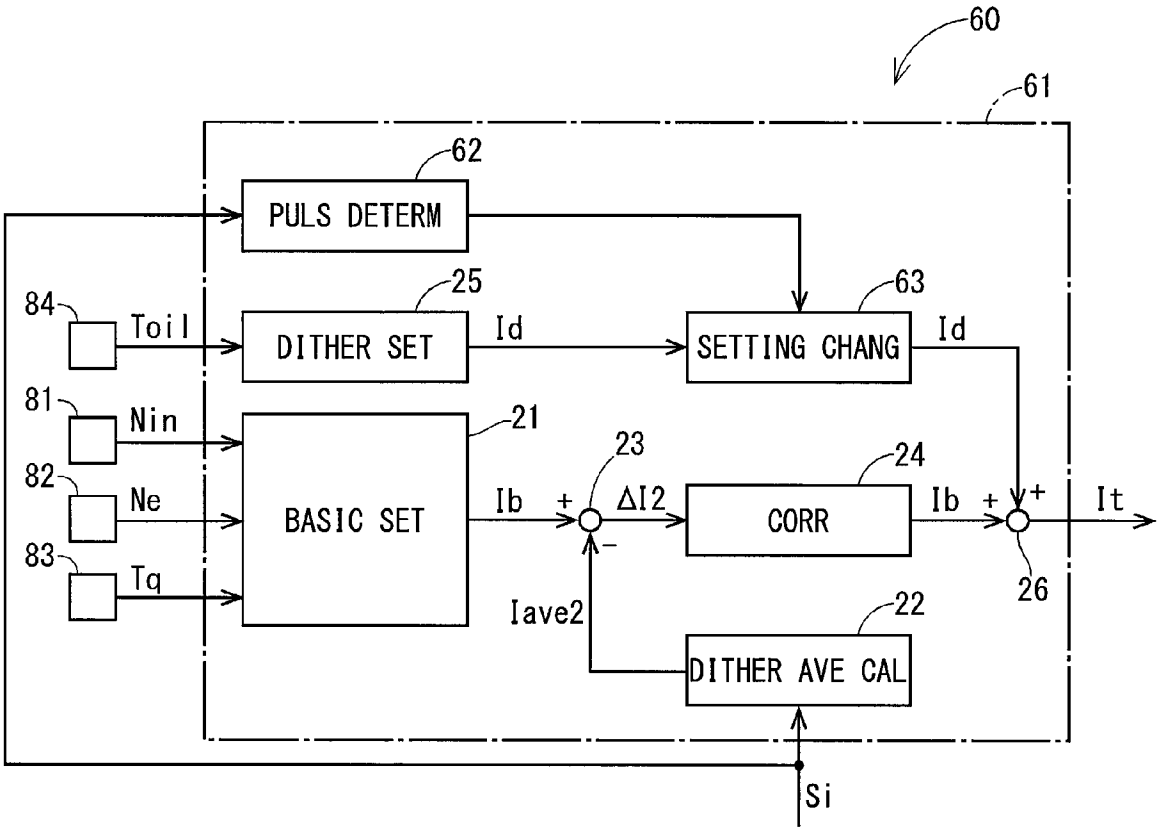
FIG. 10 is a block diagram illustrating a target setting section of the current control device shown in FIG. 9.

In particular, as shown in FIG. 10, the current control device 60 has a target setting section 61. The target setting section 61 includes a pulsation determining portion 62 and a setting-change portion 63. The pulsation determining portion 62 determines that the output oil pressure of the linear solenoid valve 94 pulsates when an amplitude Ai of the actual exciting current of the solenoid 95 is equal to or less than a predetermined value A1 based on the exciting current signal Si.

In the present embodiment, the amplitude Ai of the exciting current is a difference between the maximum value and the minimum value of the actual exciting current in the latest one dither period. The predetermined value A1 is a value determined according to the basic current value Ib and the operation state. The predetermined value A1 is experimentally calculated beforehand and provided in a map.

When the pulsation determining portion 62 determines that the output oil pressure of the linear solenoid valve 94 pulsates, the setting-change portion 63 changes the dither period Td of the dither current value Id set by the dither setting portion 25. In the present embodiment, in the case where the output oil pressure pulsates, the setting-change portion 63 shortens the dither period Td by a predetermined time. When the dither period Td is shortened, a dither frequency, which is a frequency of the dither current value Id, increases. That is, the shortening of the dither period Td is equivalent to the increase of the dither frequency. In this case, the predetermined time is determined according to the operation state. The predetermined time is experimentally calculated and mapped beforehand as the value that reduces the pulsation of the output oil pressure of the linear solenoid valve 94.

Next, a control process performed by the current control device 60 will be described with reference to FIGS. 11 and 12.

Figure 11:
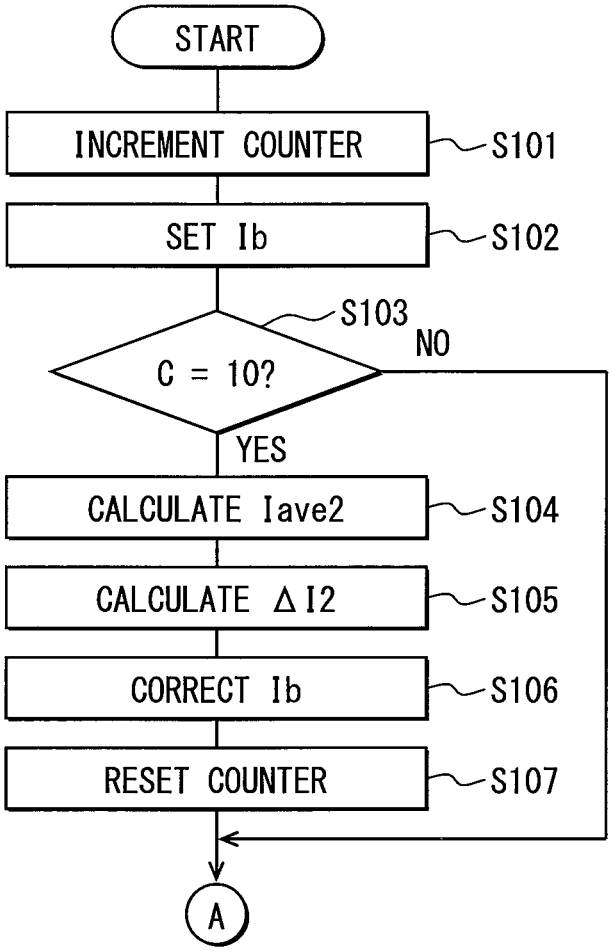
FIG. 11 is a flowchart illustrating a control operation of the current control device shown in FIG. 9.
Figure 12:
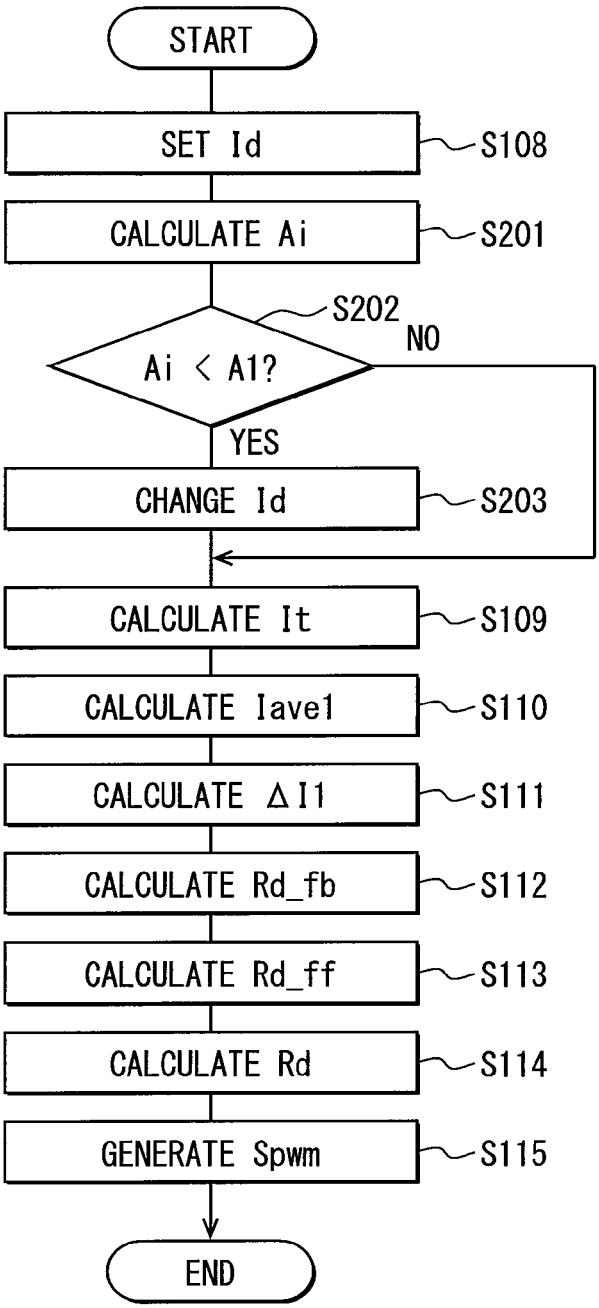
FIG. 12 is a flowchart illustrating a control operation of the current control device subsequent to the control operation shown in FIG. 11.

The current control device 60 performs the process from S101 of FIG. 11 to S108 of FIG. 12. After S108 of FIG. 12, the process proceeds to S201 of FIG. 12.

At S201, the amplitude Ai of the actual exciting current of the solenoid 95, that is, the difference between the maximum value and the minimum value of the actual exciting current in the latest one dither period Td is calculated. After S201, the process proceeds to S202.

At S202, it is determined whether the amplitude Ai of the exciting current is equal to or less than the predetermined value A1. When it is determined that the amplitude Ai of the exciting current is equal to or less than the predetermined value A1 (S202: YES), the process proceeds to S203. When it is determined that the amplitude Ai of the exciting current is greater than the predetermined value A1 (S202: NO), the process proceeds to S109.

At step S203, the dither current value Id set at S108 is changed so that the dither period Td is shortened by the predetermined time. After S203, the process proceeds to S109.

Figure 13:
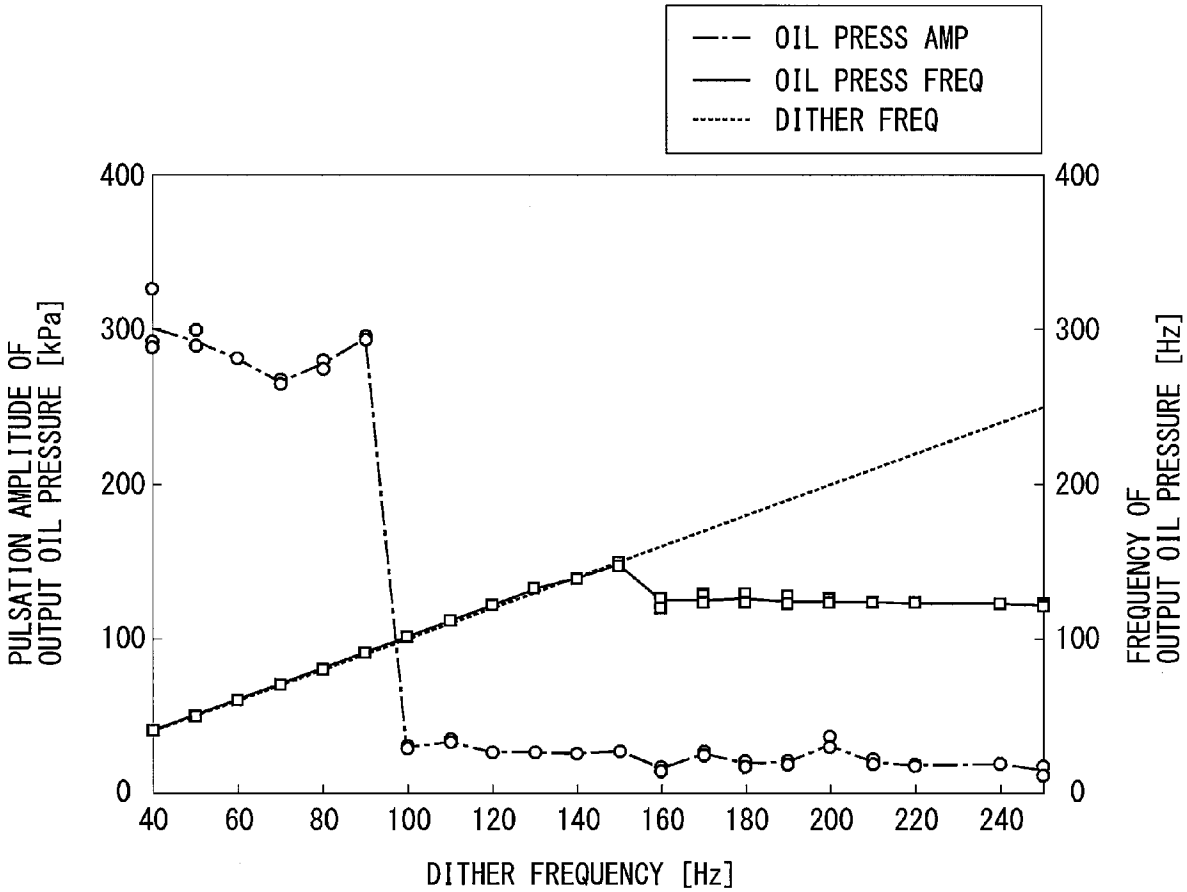
FIG. 13 is a graph illustrating a relationship between a dither frequency and a frequency of an output oil pressure in a predetermined operation state and a relationship between the dither frequency and a pulsation amplitude of the output oil pressure according to the second embodiment.

In FIG. 13, a solid line represents a relationship between the dither frequency and the frequency of the output oil pressure in a certain operation state, and a single dashed chain line represents a relationship between the dither frequency and the pulsation amplitude of the output oil pressure. The frequency of the output oil pressure increases with the increase of the dither frequency, when the dither frequency is equal to or less than 150 [Hz]. The frequency of the output oil pressure is settled to a predetermined value when the dither frequency exceeds 160 [Hz].

The pulsation amplitude of the output oil pressure is relatively high, when the dither frequency is equal to or less than 90 [Hz]. The pulsation amplitude of the output oil pressure is low when the dither frequency is equal to or greater than 100 [Hz]. A region where the dither frequency is equal to or less than 90 [Hz] is referred to as an oscillation region. A region where the dither frequency is equal to or greater than 100 [Hz] is referred to as a pulsation reduction region. The predetermined time used by the setting-change portion 63 is experimentally determined beforehand for each operation state to a value so that the dither frequency changes from the oscillation region to the pulsation reduction region.

Figure 14:
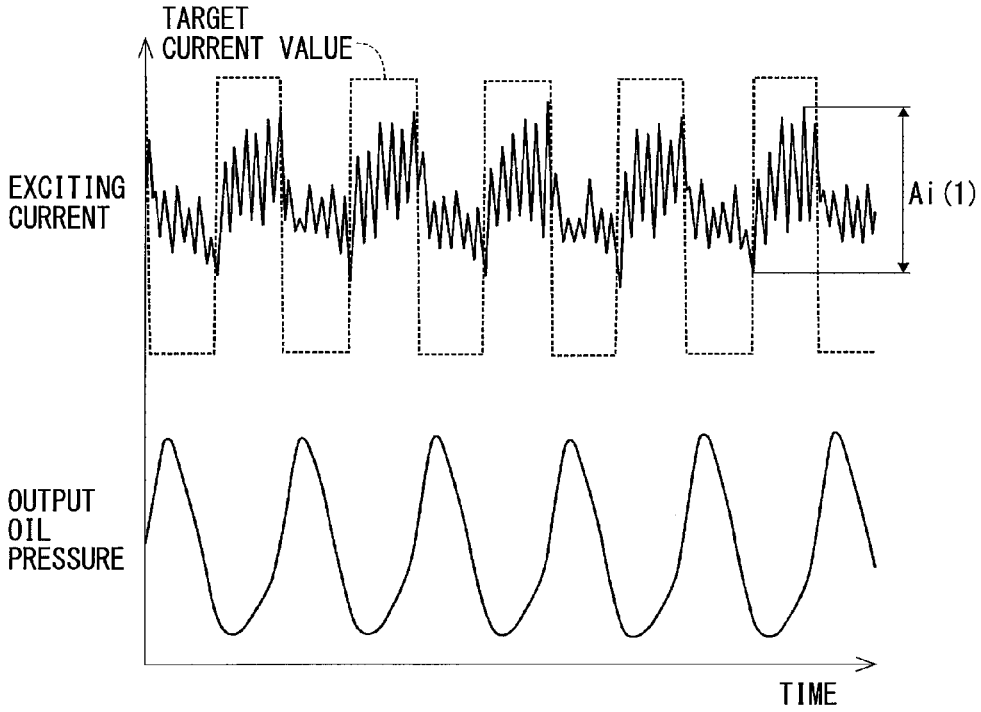
FIG. 14 is a time chart illustrating a change of an exciting current and a change of an output oil pressure when the dither frequency is 90 [Hz] in FIG. 13.
Figure 15:
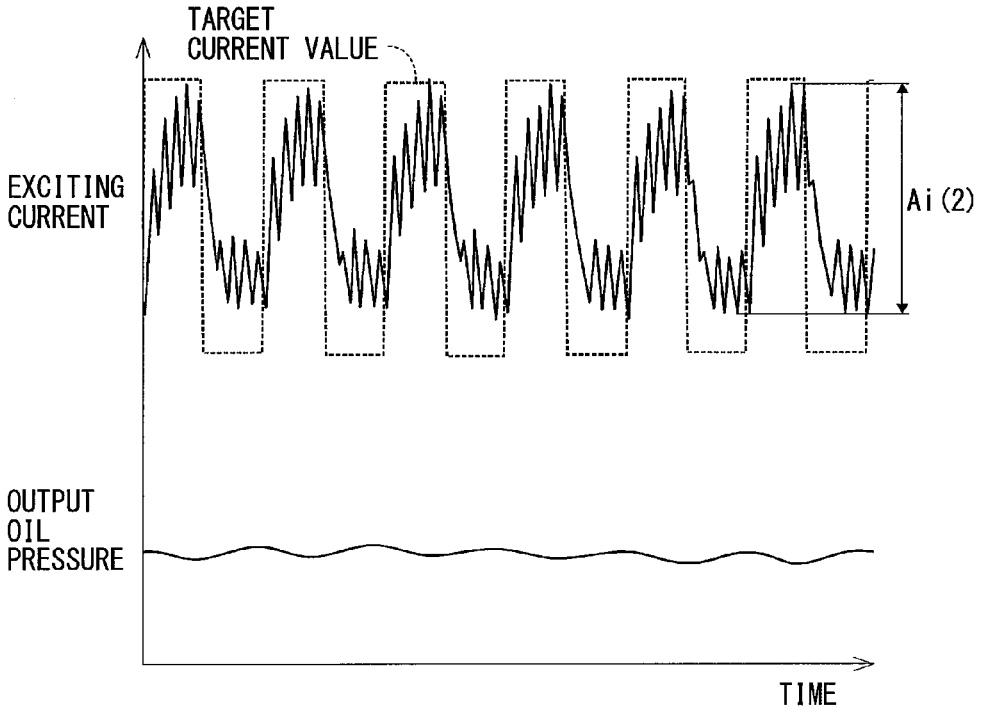
FIG. 15 is a time chart illustrating a change of an exciting current and a change of an output oil pressure when the dither frequency is 100 [Hz] in FIG. 13.

FIG. 14 illustrates a change of the exciting current and a change of the output oil pressure with time when the dither frequency is 90 [Hz] in FIG. 13. FIG. 15 illustrates a change of the exciting current and a change of the output oil pressure with time when the dither frequency is 100 [Hz] in FIG. 13.

As shown in FIG. 14, when the pulsation amplitude of the output oil pressure is relatively large, the amplitude Ai(1) of the exciting current is relatively small. On the other hand, as shown in FIG. 15, when the pulsation amplitude of the output oil pressure is relatively small, the amplitude Ai(2) of the exciting current is relatively large.

The predetermined value A1 used by the pulsation determining portion 62 is experimentally determined beforehand for each basic current value Ib and operation state to a value that is greater than the amplitude Ai(1) and smaller than the amplitude Ai(2).

In the second embodiment, as described above, the current control device 60 includes the target setting section 61. In the target setting section 61, the pulsation determining portion 62 determines whether the output oil pressure of the linear solenoid valve 94 pulsates. When the pulsation determining portion 62 determines that the output oil pressure of the linear solenoid valve 94 pulsates, the setting-change portion 63 changes the dither period Td of the dither current value Id so that the dither period Td is shortened by the predetermined time. Therefore, the dither frequency changes from the oscillation region to the pulsation reduction region, and thus the pulsation of the output oil pressure of the linear solenoid valve 94 can be reduced.

Other Embodiment

The dither period may be set to a length that is several times the PWM period. Namely, the dither period is longer than the PWM period at least.

The dither setting portion may set the dither period according to the oil temperature of the oil pressure circuit. Alternatively, the dither setting portion may set the dither amplitude and the dither period according to the oil temperature of the hydraulic circuit.

The first setting period and the second setting period may be longer than the PWM period. Yet, the first setting period and the second setting period are shorter than the dither period. For example, when the dither period is set to the length of ten times the PWM period, the first setting period and the second setting period may be set to the length of twice the PWM period, or may be set to any length shorter than the dither period.

For example, the first setting period and the second setting period may be equal to or shorter than the PWM period. In such a case, the operation responsiveness of the movable core of the solenoid further improves.

The second setting period may have the length different from the length of the first setting period.

In the embodiments described above, the dither current value is changed to repeat the large value and the small value in every half of the dither period. Alternatively, the dither current value may be changed to repeat three or more values. For example, the dither current value may be changed to repeat three different values in every ¼ of the dither period, in such a manner from a middle value, a maximum value, the middle value, a minimum value and the middle value.

The correlation value of the ambient temperature of the solenoid may not be limited to the oil temperature of the hydraulic circuit. The correlation value of the ambient temperature of the solenoid may be any other parameter, such as an outside air temperature.

In the second embodiment, the amplitude Ai of the exciting current is the difference between the maximum value and the minimum value of the actual exciting current in the latest one dither period. As another example, the amplitude Ai of the exciting current may be a difference between a maximum value and a minimum value of the average value of the actual exciting current in the latest one dither period. As further another example, when a current corresponding to the minimum value of the target current value is defined as a first exciting current, and a current corresponding to the maximum value of the target current value is defined as a second exciting current, the amplitude Ai of the exciting current may be a difference between the average value of the second exciting current and the average value of the first exciting current in the latest one dither period.

In the second embodiment, the setting-change portion 63 shortens the dither period by the predetermined time, when the pulsation of the output oil pressure is detected. As another example, the setting-change portion may lengthen the dither period or change the amplitude of the dither current value, when the pulsation of the output oil pressure is detected. As further another example, the setting-change portion may change whether the dither period is to be lengthened or shortened depending on the operation state.

The current control device may be employed to a solenoid of any device, such as a hydraulic control valve, and an electromagnetic valve for controlling a pressure or a flow rate, in addition to the linear solenoid valve While only the selected exemplary embodiment and examples have been chosen to illustrate the present disclosure, it will be apparent to those skilled in the art from this disclosure that various changes and modifications can be made therein without departing from the scope of the disclosure as defined in the appended claims. Furthermore, the foregoing description of the exemplary embodiment and examples according to the present disclosure is provided for illustration only, and not for the purpose of limiting the disclosure as defined by the appended claims and their equivalents.

What is claimed is:

1. A current control device for controlling an exciting current of a solenoid, the current control device comprising:

a target setting section setting a target current value of the exciting current;

a duty ratio setting section setting a duty ratio of a pulse width modulation (PWM) signal, which is provided to a drive circuit of the solenoid, based on the target current value; and a signal generating section generating the PWM signal, wherein the target current value is a value that periodically varies in a dither period longer than a PWM period, which is a pulse period of the PWM signal, the target setting section sets the target current value in every first setting period, the duty ratio setting section sets the duty ratio in every second setting period, and the first setting period and the second setting period are shorter than the dither period.

2. The current control device according to claim 1, wherein the first setting period and the second setting period are equal to or shorter than the PWM period.

3. The current control device according to claim 1, wherein the second setting period is equal to the first setting period.

4. The current control device according to claim 1, wherein the target setting section includes:

a basic setting portion setting a basic current value that corresponds to a desired operation state of the solenoid;

a dither setting portion setting a dither current value that is an oscillation component to create small oscillation of a movable core of the solenoid and periodically varies in the dither period; and a target calculating portion calculating the target current value by adding the basic current value and the dither current value.

5. The current control device according to claim 4, wherein the dither setting portion sets an amplitude of the dither current value or the dither period according to a correlation value of an ambient temperature of the solenoid.

6. The current control device according to claim 4, wherein the target setting section includes:

a pulsation determining portion determining whether an amplitude of the exciting current is equal to or less than a predetermined value; and a setting-change portion changing an amplitude of the dither current value or the dither period set by the dither setting portion, when the pulsation determining portion determines that the amplitude of the exciting current is equal to or less than the predetermined value.

7. The current control device according to claim 1, wherein the duty ratio setting section includes:

a PWM average calculating portion calculating an average value of the exciting current in one PWM period as a PWM average current value; and a feedback control portion setting the duty ratio based on a deviation between the target current value and the PWM average current value.

8. The current control device according to claim 1, wherein the target setting section includes:

a dither average calculating portion calculating an average value of the exciting current in one dither period as a dither average current value; and a correcting portion correcting the basic current value based on a deviation between the basic current value and the dither average current value.

9. The current control device according to claim 1, wherein the solenoid is included in a linear solenoid valve that controls a pressure.

10. The current control device according to claim 9, wherein the linear solenoid valve has a spool-type solenoid valve.

11. The current control device according to claim 9, wherein the linear solenoid valve is a hydraulic control valve that controls a pressure of a hydraulic oil supplied to a hydraulic actuator of an automatic transmission.

12. A non-transitory computer readable storage medium comprising instructions to be executed by a computer for controlling an exciting current of a solenoid, the instructions for at least implementing:

setting a target current value of the exciting current in every first setting period;

setting a duty ratio of a pulse width modulation (PWM) signal, which is provided to a drive circuit of the solenoid, based on the target current value in every setting period; and generating the PWM signal, wherein the target current value is a value that periodically varies in a dither period longer than a PWM period, which is a pulse period of the PWM signal, and the first setting period and the second setting period are shorter than the dither period.

13. A method for controlling an exciting current of a solenoid, the method comprising:

setting a target current value of the exciting current in every first setting period;

setting a duty ratio of a pulse width modulation (PWM) signal, which is provided to a drive circuit of the solenoid, based on the target current value in every second setting period; and generating the PWM signal, wherein the target current value is a value that periodically varies in a dither period longer than a PWM period, which is a pulse period of the PWM signal, and the first setting period and the second setting period are shorter than the dither period.

14. The non-transitory computer readable storage medium according to claim 12, the instructions to be executed by the computer further implementing:

setting a basic current value that corresponds to a desired operation state of the solenoid;

setting a dither current value that is an oscillation component to create small oscillation of a movable core of the solenoid and periodically varies in the dither period; and calculating the target current value by adding the basic current value and the dither current value.

15. The non-transitory computer readable storage medium according to claim 14, wherein an amplitude of the dither current value or the dither period is set according to a correlation value of an ambient temperature of the solenoid.

16. The non-transitory computer readable storage medium according to claim 14, the instructions to be executed by the computer further implementing:

determining whether an amplitude of the exciting current is equal to or less than a predetermined value; and changing an amplitude of the set dither current value or the set dither period when a determination is made that the amplitude of the exciting current is equal to or less than the predetermined value.

17. The non-transitory computer readable storage medium according to claim 12, the instructions to be executed by the computer further implementing:

calculating an average value of the exciting current in one dither period as a dither average current value; and correcting the basic current value based on a deviation between the basic current value and the dither average current value.

18. The method according to claim 13, further comprising:

setting a basic current value that corresponds to a desired operation state of the solenoid;

setting a dither current value that is an oscillation component to create small oscillation of a movable core of the solenoid and periodically varies in the dither period; and calculating the target current value by adding the basic current value and the dither current value.

19. The method according to claim 18, wherein an amplitude of the dither current value or the dither period is set according to a correlation value of an ambient temperature of the solenoid.

20. The method according to claim 18, further comprising:

determining whether an amplitude of the exciting current is equal to or less than a predetermined value; and changing an amplitude of the set dither current value or the set dither period when a determination is made that the amplitude of the exciting current is equal to or less than the predetermined value.

21. The method according to claim 13, further comprising:

calculating portion calculating an average value of the exciting current in one dither period as a dither average current value; and correcting the basic current value based on a deviation between the basic current value and the dither average current value.

* * * * *